United States Patent [19]

Warzinski et al.

[11] Patent Number: 4,695,372

[45] Date of Patent: Sep. 22, 1987

[54] CONDITIONING OF CARBONACEOUS MATERIAL PRIOR TO PHYSICAL BENEFICIATION

[75] Inventors: Robert P. Warzinski, Venetia; John A. Ruether, McMurray, both of Pa.

[73] Assignee: The United States of America as represented by the United States Department of Energy, Washington, D.C.

[21] Appl. No.: 863,650

[22] Filed: May 15, 1986

[51] Int. Cl.[4] ..... C10G 17/04

[52] U.S. Cl. ..... 208/311; 208/309; 208/314; 208/424; 208/426; 208/952; 209/3

[58] Field of Search ..... 208/309, 314, 311, 313, 208/952, 424, 426; 209/3

[56] References Cited

U.S. PATENT DOCUMENTS

| | | | |
|---|---|---|---|
| 3,607,717 | 9/1971 | Reach | 208/425 |
| 3,768,988 | 10/1973 | Meyer | 44/1 R |
| 3,807,557 | 4/1974 | Miller | 209/166 |
| 3,815,826 | 6/1974 | Aldrich et al. | 241/1 |
| 3,850,477 | 11/1974 | Aldrich et al. | 208/400 |
| 3,909,211 | 9/1975 | Diaz et al. | 44/1 R |
| 3,938,966 | 2/1976 | Kindig et al. | 44/1 R |
| 3,960,513 | 6/1976 | Agarwal et al. | 44/1 R |
| 4,162,958 | 7/1979 | Baldwin | 208/424 |
| 4,192,731 | 3/1980 | Stearns et al. | 208/390 |
| 4,217,201 | 8/1980 | Chervenak | 208/426 |
| 4,248,692 | 2/1981 | Knebel et al. | 208/432 |
| 4,388,171 | 6/1983 | Corcoran et al. | 208/435 |
| 4,402,821 | 9/1983 | Yan | 208/952 |
| 4,426,281 | 1/1984 | Meyers et al. | 208/426 |

OTHER PUBLICATIONS

Warzinski et al, Div. of Fuel Chemistry (1985), A. C. S. (Sep. 8-13, 1985), vol. 30, No. 4, pp. 244–249.

Warzinski, ACS, Div. of Fuel Chemistry, vol. 30, No. 3, pp. 139-147 (Sep. 8-13, 1985).

Warzinski and Cavallaro, "Physical Beneficiation of Char and Chemically Conditioning Coal".

C&EN, Nov. 20, 1978, pp. 29-30, "Supercritical Solvents Enhance Coal Liquefaction".

*Primary Examiner*—Asok Pal

*Attorney, Agent, or Firm*—Hugh W. Glenn; Robert J. Fisher; Judson R. Hightower

[57] ABSTRACT

A carbonaceous material such as coal is conditioned by contact with a supercritical fluid prior to physical beneficiation. The solid feed material is contacted with an organic supercritical fluid such as cyclohexane or methanol at temperatures slightly above the critical temperature and pressures of 1 to 4 times the critical pressure. A minor solute fraction is extracted into critical phase and separated from the solid residuum. The residuum is then processed by physical separation such as by froth flotation or specific gravity separation to recover a substantial fraction thereof with reduced ash content. The solute in supercritical phase can be released by pressure reduction and recombined with the low-ash, carbonaceous material.

9 Claims, 3 Drawing Figures

CONDITIONING OF CARBONACEOUS MATERIAL PRIOR TO PHYSICAL BENEFICIATION

CONTRACTUAL ORIGIN OF THE INVENTION

The United States Government has rights in this invention due to the Employer/Employee relationship of the inventor to the U.S. Department of Energy at the Pittsburgh Energy Research and Technology Center.

BACKGROUND OF THE INVENTION

This invention relates to a method for conditioning coal or other carbonaceous material prior to physical separation. In particular, the pretreatment involves the use of supercritical fluids in conditioning the carbonaceous material.

Several factors limit the increased efficient utilization of coal. The gaseous release of the sulfur and nitrogen species in coal upon combustion has been and remains one of the most important limitations to increased utilization. Also the presence of high levels of mineral matter prohibit the use of coal, especially in markets traditionally dominated by petroleum products and natural gas.

Commercial approaches to coal cleaning rely on differences in the physical properties of the coal and mineral matter to reject the undesirable portion of the coal. Many coals are known to be unresponsive to such techniques due to a variety of reasons, one of which is the incomplete segregation of mineral matter from the organic matrix of the coal.

Chemical treatment of coal after physical beneficiation has been used in coal cleaning. Size reduction and classification in the physical process steps improve the activity of any chemical treatment that is later used. Recently, however, there have been suggestions to reverse this order of treatment to improve grindability, increase coal/ash fusion temperatures and preserve combustable volatiles. In one instance, a carbon dioxide and water mixture was used for the pretreatment of coal prior to its physical benefication. The coal was treated substantially below supercritical density and there was no significant extraction of soluble components into the carbon dioxide and water.

It is known that certain gas phases maintained near to supercritical conditions are capable of taking up large amounts of solutes from liquid or solid materials. When conditions such as temperature or pressure are reduced to below critical, a substantial decrease in solubility results. Also increases, particularly in temperature, to well above critical likewise reduce solubility in the supercritical gas. For purposes of this application, the terms "supercritical solvent", "supercritical phase", or "supercritical fluid" refer to a gas or gas mixture, in some instances with solute, at or above critical temperature and critical pressure.

There is increasing interest in the identification, development, and characterization of new coal derived fuels. Not only is there interest in beneficiating coal by the removal of ash and sulfur but also there is interest in beneficiating various char products from pyrolysis and gasification processes. Since a large portion of the calorific value of the coal ends up in the char, the benefication of this material can produce an important fuel. Removing the ash from char can produce serious difficulties in that char formation may fuse the organic and mineral matter and retard separation.

Therefore, in view of the above, it is an object of the present invention to provide an improved method of beneficiating carbonaceous material.

It is a further object to provide a method of reducing the ash content of a coal or char.

It is a further object of the invention to provide a method of removing ash and sulfur from carbonaceous material without comminution to fine particles.

It is also an object to provide a premium ash-free fraction in a process for the reduction of ash in a carbonaceous material.

SUMMARY OF THE INVENTION

In accordance with the present invention, a method of beneficiating carbonaceous material is provided. The method involves contacting the carbonaceous material with a supercritical fluid to extract a solute into supercritical phase leaving a solid residuum of the material. The solid residuum is subjected to a physical separation to provide a major fraction with reduced ash content and a minor portion of the residuum with high ash content.

In other aspects of the invention, the solute is released from the supercritical phase to provide a premium fraction of reduced ash. This solute can be recovered by reducing the pressure of the supercritical fluid to below its critical pressure. The solute is at least one percent and advantageously is in the range of 1–15% by weight of the carbonaceous material.

In more specific aspects, the supercritical fluid is an organic material having a critical temperature in the range of about 180° C. to 300° C. The fluid is selected from various materials capable of dissolving organic material from coal or coal char at a temperature near to but slightly above its critical temperature. By skillful selection of the supercritical fluid, sufficiently low process temperatures can be employed to avoid softening of the carbonaceous material. Advantageous selections of the supercritical fluid include cyclohexane and methanol. The use of methanol has been found to reduce sulfur content in the clean coal following physical processing.

DETAILED DESCRIPTION OF THE DRAWINGS

The present invention is illustrated in the accompanying drawings wherein.

DETAILED DESCRIPTION OF THE PREFERRED EMBODIMENT

Figure 1:
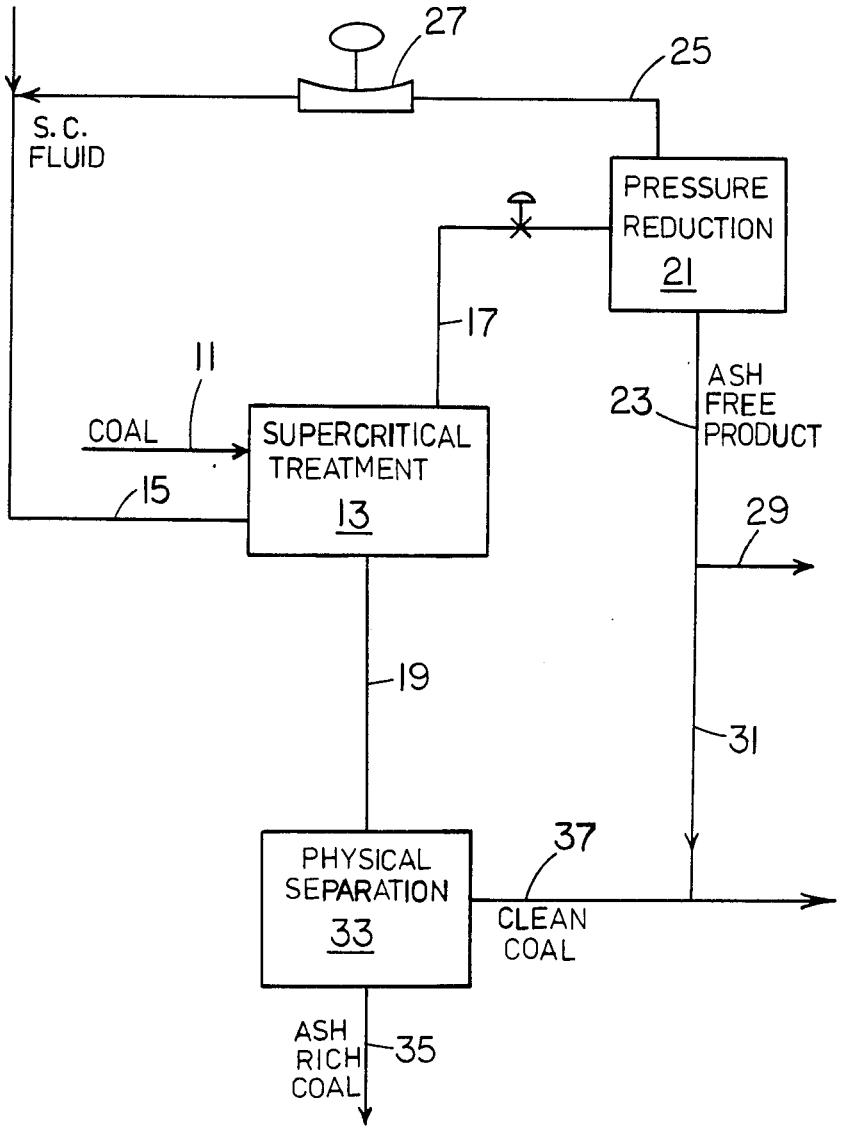
FIG. 1 is a schematic flow diagram illustrating a process for the benefication of carbonaceous material.

The benefication process of the the present invention is decribed with reference to FIG. 1. Coal or other carbonaceous material 11 is contacted with a supercritical fluid 15 within vessel 13 and the products separated into a supercritical phase at 17 and residual solids at 19. Supercritical phase 17 includes a solute of soluble organic materials, up to about 15 weight percent of the carbonaceous material 11. The solute is released from supercritical phase such as by pressure reduction in vessel 21 from which a premium ash-free product 23 and a gas flow 25 are removed. As is well understood, the reduction of pressure below the critical pressure greatly reduces the solubility of many organic solutes in supercritical fluids. The resulting gas 25 is recompressed in recompression device 27 and cooled for recycle as supercritical fluid 15 into contact with the carbonaceous material 11. Ash-free product 23 can be recovered as a premium product 29 or combined at 31 with the clean carbonaceous material.

Only a small portion of the carbonaceous material 11 is removed with the solute 17. The solute should be at least one percent and advantageously in the range of 1–15% by weight of the carbonaceous material. The greater portion of the material 11 is withdrawn from the supercritical treatment as solids 19 and is subjected to a physical separation process 33.

Separation process 33 can be one of various physical separation methods based on specific gravity or froth flotation. In specific gravity separations, the ash and pyrite fractions settle in a liquid of selected specific gravity while a clean fraction 37 floats in the liquid for withdrawal. The separation based on specific gravity can be implemented by use of commercially available settling tanks or centrifugal equipment.

Physical separation 33 also may be carried out as a froth flotation process. One particularly, advantageous process for separating pyrite from coal is described in U.S. Pat. No. 3,807,557 to Miller. This patent is incorporated by reference for this purpose. In this two-stage froth flotation process, coal is aerated to produce a froth product which is separated by conventional means such as froth scrapers or paddles. Coarse pyrite is removed as underflow. In the second stage of the process, the froth product from the first stage is subjected again to froth floatation using a coal floatation depressant and a pyrite floatation collector to remove a substantial portion of the remaining pyrite. The clean coal product is recovered with the underflow.

Vessel 13 in which the supercritical treatment is performed can be any of the various types of gas-liquid-solid contacting devices. For instance, a column of liquid and solid through which a supercritical fluid is passed can be employed in a similar manner to that described in the assignee's copending patent application, Ser. No. 863,494, by Warzinski, entitled "Stepwise Supercritical Extraction of Carbonaceous Residua", filed 5/15/1986, Ser. No. 863,494. This application is incorporated by reference herein to describe means for contacting liquids and solids with supercritical fluids or solvents.

Various organic solvents can be selected for use as a supercritical fluid in the present process. In order to enhance the solubility of the organic solute from the carbonaceous material into the supercritical solvent, the process is operated, above but near to, critical conditions. Advantageously, the process is operated at about 1.0 to 1.1 of the absolute critical temperature (Tc) and at about one to four times the absolute critical pressure (Pc). In these ranges solubility of the organic compounds of coal and char are greatly enhanced for extraction into the supercritical phase.

It is of considerable importance that the supercritical fluid be selected to have critical temperatures within a range to permit solute dissolution without adversely affecting the subsequent ash separation. In general, critical temperatures of 180° C. to 300° C. (453–573 K) are contemplated for use. Temperatures much above this range can soften the coal or char causing it to flow around and more firmly entrap the ash and mineral matter into the matrix. Too low a critical and operating temperature will not permit the extraction of a premium ash-free product from the coal. The extraction of solute is of importance, not only to allow recovery of the premium product, but also to open the carbonaceous material matrix for subsequent separation of ash. Table 1 given below lists several solvents with their critical constants contemplated for the present process.

TABLE 1

| Solvent | Critical Constants Tc °K. | Pc Atm |
|---|---|---|
| 2 Methylbutane | 461 | 32.9 |
| N—Pentane | 470 | 33.1 |
| Hexane | 508 | 29.9 |
| 2 Methylpentane | 498 | 29.9 |
| 5 Methylpentane | 505 | 30.8 |
| 2,2-Dimethylbutane | 489 | 30.7 |
| 2,3-Dimethylbutane | 500 | 31 |
| Methanol | 512 | 79.2 |
| Cyclohexane | 553 | 40.1 |
| Benzene | 562 | 49 |

EXAMPLE 1

Illinois No. 6 coal is ground to pass about 1.5 millimeter screen apertures (14 mesh) and placed in a reaction vessel for contact with a flow of cyclohexane at a temperature of about 1.02 Tc and a pressure of about 2 Pc. The flow of cyclohexane is continued until about 10% by weight of the coal is extracted into supercritical phase. The solute is recovered as an ashfree, coal liquid by reducing the pressure to atmospheric, well below the critical pressure for cyclohexane. The residual solid coal is subjected to a specific gravity separation to recover the clean coal from the ash.

EXAMPLE 2

The process of Example 1 is performed except that methanol, at 250° C. and at 325° C., is used as the supercritical solvent with other conditions substantially the same.

EXAMPLE 3

As a comparision with the results obtained in the performance of the present invention, toluene having a critical temperature outside the preferred range, e.g. 320.4° C. is employed in a procedure similar to that of Example 1. The separation of ash in a specific gravity separation is clearly less effective than when cyclohexane or methanol are used as the critical solvent.

Table 2 below gives the analyses of the untreated Illinois No. 6 coal used in the above Examples along with the various extracts obtained with the supercritical fluids. Extracts of about 9, 12, and 23% by weight were obtained for methanol, cyclohexane, and toluene respectively.

TABLE 2

| Coal Treatment | Analyses of Coals and Coal Extracts C | H | O | N | S | ASH | H/C | $\overline{M}w$ |
|---|---|---|---|---|---|---|---|---|
| Illinois No. 6 No Treatment | 62.92 | 4.68 | 12.40 | 0.86 | 4.80 | 14.34 | 0.886 | — |
| Cyclohexane | 83.45 | 6.75 | 6.51 | 1.01 | 2.30 | 0.12 | 0.964 | 460 |
| Toluene | 82.65 | 6.21 | 7.91 | 1.05 | 2.35 | 0.05 | 0.895 | 579 |
| (Replicate) | 82.08 | 6.23 | 7.97 | 1.19 | 2.64 | 0.02 | 0.904 | 531 |
| Methanol, 250° C. | 79.91 | 6.74 | 9.44 | 1.27 | 2.61 | 0.51 | 1.005 | 515 |

TABLE 2-continued

| Coal Treatment | Analyses of Coals and Coal Extracts | | | | | | | |
|---|---|---|---|---|---|---|---|---|
| | C | H | O | N | S | ASH | H/C | $\overline{M}w$ |
| Methanol, 325° C. | 81.13 | 6.91 | 8.55 | 1.14 | 2.20 | 0.15 | 1.015 | 434 |

In order to determine the appropriate liquid specific gravity for use in the physical separations and to determine the effectiveness of the several supercritical solvents, a series of sink-float separations were conducted. Liquids of 1.25, 1.28, 1.30, 1.40, and 1.60 were used in these separation tests. For comparison the sink-float separations also were performed on raw coal. In each separation the yield, ash content and sulfur content of both the sink and float fractions were determined. The results of these tests are shown in FIGS. 2 and 3.

Figure 2:
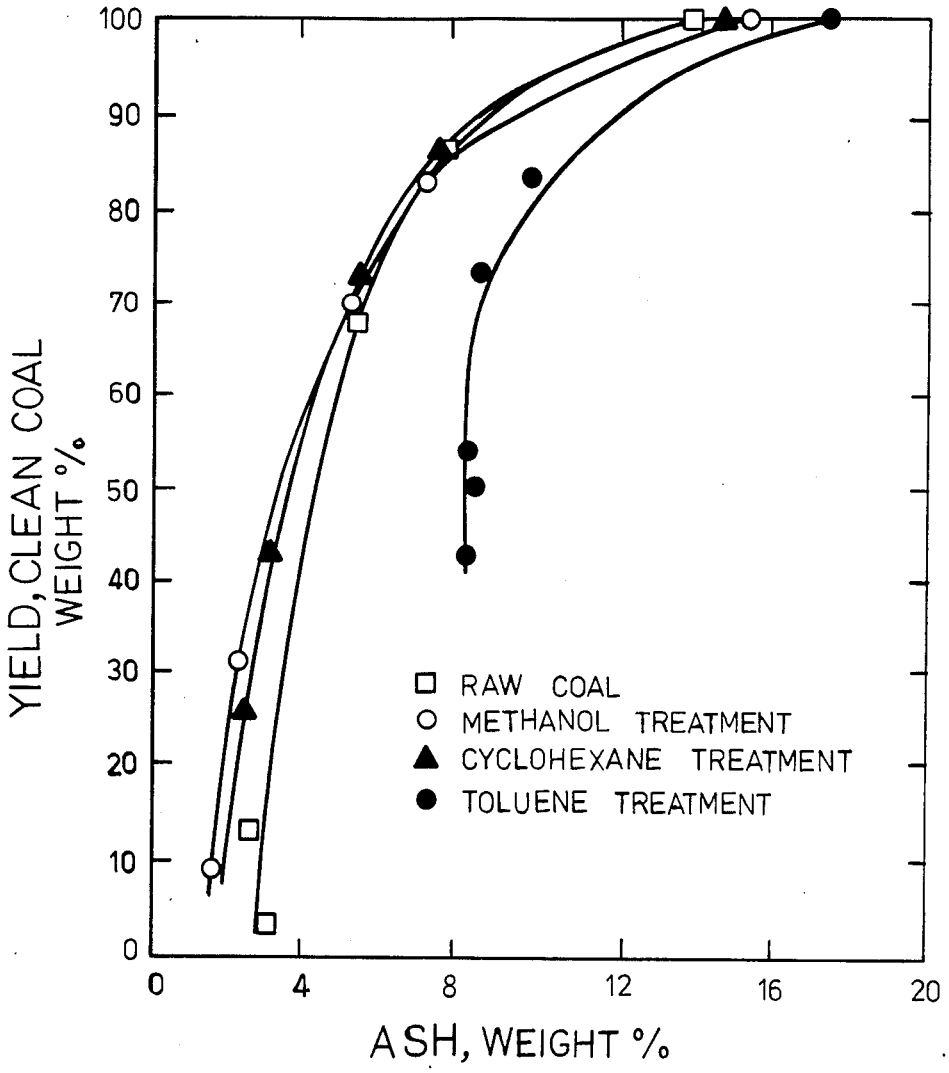
FIG. 2 is a graph illustrating yield versus ash content in specific gravity, sink-float tests for raw coal and coal treated with various supercritical fluids.

In FIG. 2, the yield of clean coal that can be obtained at the various ash levels in specific gravity separations is shown. It is clearly seen that the treatment with supercritical toluene hinders the separation of ash by specific gravity methods while both cyclohexane and methanol provide improvement.

Figure 3:
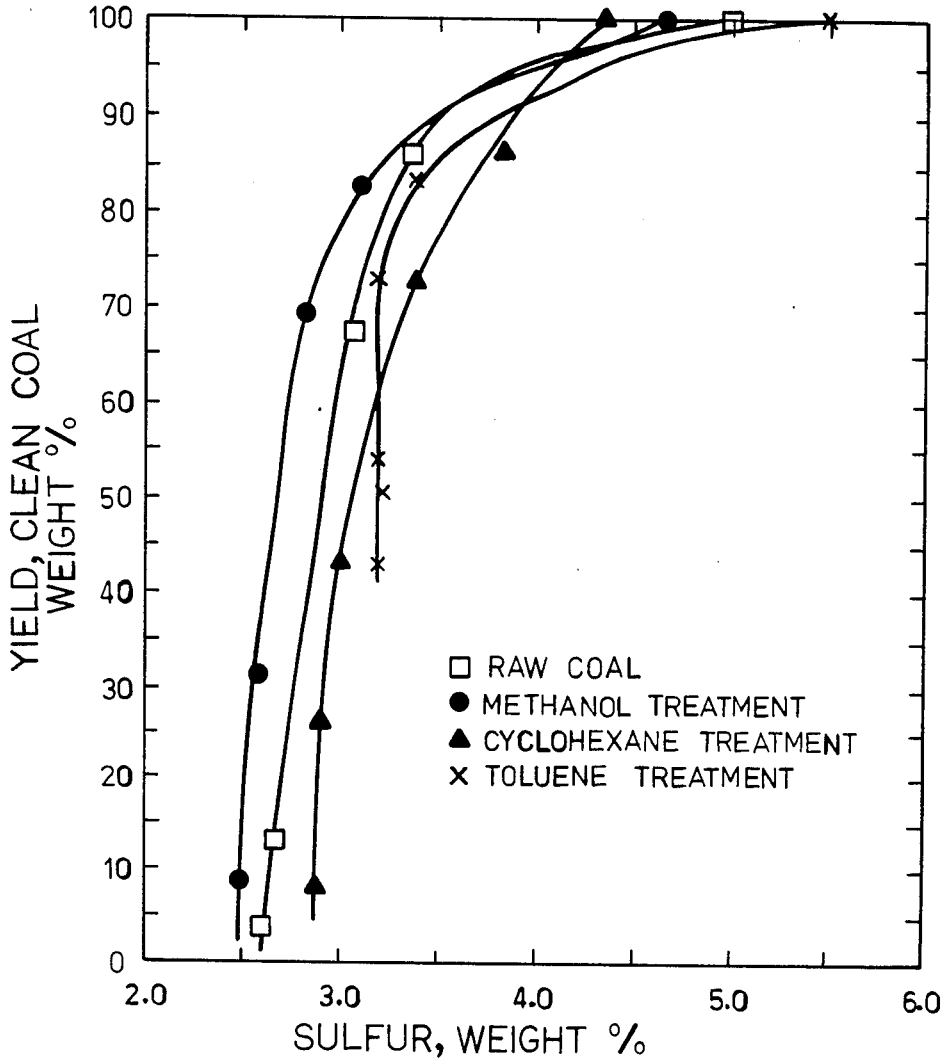
FIG. 3 is a graph of yield versus sulfur content in the specific gravity tests of FIG. 2.

FIG. 3 shows the yield of clean coal plotted against the total sulfur appearing in the coal. It is seen that treatment with supercritical methanol enhances the removal of sulfur in the performance of the present process. Treatment with supercritical cyclohexane or toluene result in a slight increase in sulfur content over that of coal without supercritical treatment.

It is therefore seen that through use of the present invention, significant reduction in ash content can be obtained in a specific gravity-type separation following a supercritical extraction. Through selection of supercritical solvents of appropriate critical temperatures, the matrix of the coal or other carbonaceous material can be opened to facilitate ash separation in a specific gravity-type process. Although it has not been tried, it also is expected that such supercritical treatment will likewise enhance ash removal in froth flotation processes. These advantages can be obtained without resorting to ultrafine grinding and comminution of the carbonaceous material. In addition to the enhanced ash separation, the selection of methanol as the supercritical solvent provides some measure of sulfur removal with specific gravity-type separations. It is also seen that the present process provides a small fraction of substantially ash-free, premium coal product with reduced sulfur content.

Although the present invention is described in terms of specific embodiments, it will be clear that various changes in the materials, processing conditions, and details of the invention can be made by one skilled in the art within the scope of the following claims.

The embodiments of the invention in which an exclusive property or privilege is claimed is defined as follows:

1. A method of reducing the ash content of a carbonaceous material comprising:

contacting said carbonaceous material with a supercritical fluid selected from the group consisting of methanol and cyclohexane to extract a solute into supercritical phase leaving a solid residuum;

separating the solid residuum into an ash reduced fraction and an ash-enriched fraction in a liquid of specific gravity selected to float the ash-reduced fraction and to permit the ash-enriched fraction to sink;

recovering the solute and ash-reduced fraction as product.

2. The method of claim 1 wherein said solute is released from supercritical phase and is added to said ash-reduced fraction of residuum.

3. The method of claim 2 wherein said solute is at least 1% by weight of said carbonaceous material.

4. The method of claim 2 wherein said solute is in the range of 1–15% by weight of said carbonaceous material.

5. The method of claim 1 wherein said solute is released from supercritical phase by separating the supercritical and solid phases and reducing the pressure of the fluid to below is critical pressure.

6. The method of claim 1 wherein the carbonaceous material is coal and is contacted by the supercritical fluid within 1.0 to 4.0 times the absolute critical pressure and at a temperature within 1.0 to 1.1 times the absolute critical temperature but at a sufficiently low temperature to avoid softening of the coal while extracting a minor solute fraction into supercritical phase.

7. The method of claim 6 wherein the coal is of about 0.5 to 1.5 millimeters particle size average.

8. The method of claim 1 wherein said ash-reduced fraction is a major portion and said ash-enriched fraction is a minor portion of said solid residuum.

9. The method of claim 1 wherein said supercritical fluid is methanol and said ash-reduced fraction is of lower sulfur content than said carbonaceous material.

* * * * *